US005440893A

United States Patent [19]

Davis et al.

[11] Patent Number: 5,440,893

[45] Date of Patent: Aug. 15, 1995

[54] ADAPTIVE DEFROST CONTROL SYSTEM

[75] Inventors: Kenneth Davis, Berwyn; Alvin Miller; Robert Wetekamp, both of Galesburg, all of Ill.

[73] Assignee: Maytag Corporation, Newton, Iowa

[21] Appl. No.: 202,587

[22] Filed: Feb. 28, 1994

[51] Int. Cl.[6] ..... F25D 21/06

[52] U.S. Cl. ..... 62/155; 62/234

[58] Field of Search ..... 62/155, 154, 234, 156, 62/80, 81, 82, 151, 152, 153

[56] References Cited

U.S. PATENT DOCUMENTS

| | | | |
|---|---|---|---|
| 2,091,884 | 8/1937 | Rottner | 62/4 |
| 2,888,808 | 6/1959 | Jacobs | 62/155 |
| 3,013,400 | 12/1961 | Sharpe | 62/156 |
| 3,111,814 | 11/1963 | Schumacher et al. | 62/156 |
| 3,273,352 | 9/1966 | McCready | 62/155 |
| 3,321,928 | 5/1967 | Thorner | 62/140 |
| 3,460,352 | 8/1969 | Lorenz | 62/153 |
| 3,474,638 | 10/1969 | Dodge, III | 62/153 |
| 3,518,841 | 7/1970 | West, Jr. | 62/153 |
| 3,553,975 | 1/1971 | Sakamoto | 62/156 |
| 3,759,049 | 9/1973 | Bell et al. | 62/80 |
| 3,854,915 | 12/1974 | Schulze-Berge et al. | 62/155 |
| 3,890,798 | 6/1975 | Fujimoto et al. | 62/155 |
| 4,056,948 | 11/1977 | Goodhouse | 62/155 |
| 4,104,888 | 8/1978 | Reedy et al. | 62/80 |
| 4,142,374 | 3/1979 | Ansted et al. | 62/155 |
| 4,156,350 | 5/1979 | Elliott et al. | 62/80 |
| 4,173,871 | 11/1979 | Brooks | 62/80 |
| 4,251,988 | 2/1981 | Allard et al. | 62/80 |
| 4,327,557 | 5/1982 | Clarke et al. | 62/153 |
| 4,373,349 | 2/1983 | Mueller | 62/155 X |
| 4,463,348 | 7/1984 | Sidebottom | 340/585 |
| 4,481,785 | 11/1984 | Tershak et al. | 62/153 |
| 4,528,821 | 7/1985 | Tershak et al. | 62/153 |
| 4,573,326 | 3/1986 | Sulfstede et al. | 62/156 |
| 4,627,245 | 12/1986 | Levine | 62/234 X |
| 4,665,710 | 5/1987 | Kyzer et al. | 62/155 |
| 4,680,940 | 7/1987 | Vaughn | 62/155 |
| 4,694,657 | 9/1987 | Vaughn | 62/80 |
| 4,750,332 | 6/1988 | Jenski et al. | 62/80 |
| 4,751,825 | 6/1988 | Voorhis et al. | 62/234 |
| 4,850,204 | 7/1989 | Bos et al. | 62/234 |
| 4,884,414 | 12/1989 | Bos | 62/156 |
| 4,938,027 | 7/1990 | Midlang | 62/80 |
| 5,046,324 | 9/1991 | Otoh et al. | 62/155 |
| 5,148,686 | 9/1992 | You | 62/234 |

FOREIGN PATENT DOCUMENTS

| | | |
|---|---|---|
| 0063178 | 10/1982 | European Pat. Off. . |
| 3235642 | 3/1984 | Germany . |
| 54-47148 | 4/1979 | Japan . |
| 56-3842 | 1/1981 | Japan . |
| 57-148129 | 9/1982 | Japan . |
| 2039081 | 7/1980 | United Kingdom . |

*Primary Examiner*—Harry B. Tanner
*Attorney, Agent, or Firm*—Bacon & Thomas

[57] ABSTRACT

Control of defrost cycle initiation in a refrigeration apparatus is based on the difference between the last two defrost times, taking into account the sign of the difference so that the increase or decrease in the time between defrosts corresponds to the trend in defrost times rather than on any particular defrost time or the average of defrost times. A variety of limits are included to ensure that the time between defrosts is reactive to sudden aberrational changes in defrost times, and does not exceed minimum or maximum values.

41 Claims, 3 Drawing Sheets

ADAPTIVE DEFROST CONTROL SYSTEM

BACKGROUND OF THE INVENTION

1. Field of the Invention

The present invention relates to an adaptive defrost control system for an automatically defrosting refrigeration apparatus.

2. Description of the Related Art

In a conventional refrigeration apparatus, the refrigerant evaporator accumulates frost at a rate which depends on a number of conditions. These conditions include the number of times the refrigeration apparatus is accessed, the ambient humidity, and the total accumulated compressor run time. Although these conditions are variable, in the conventional non-adaptive system, the defrost cycle is initiated a fixed period of time after the previous defrost cycle has ended, regardless of the actual frost buildup.

In order to increase efficiency and thereby reduce energy costs, as well as increase the quality of products being stored in the refrigeration apparatus, it has previously been proposed to base the initiation of the defrost cycle on need, i.e., to operate the defrost heater only when frost build-up becomes excessive. Because measurement of the actual frost accumulation is difficult, it has also been proposed to initiate the defrost time based on an estimated rather than actual frost accumulation.

This type of adaptive defrost system was disclosed, for example, in U.S. Pat. No. 3,111,894, which proposed that the rate of frost accumulation be estimated based on an assumed inverse relationship between the frost accumulation and the time required for the defrost heater to raise the evaporator temperature to a predetermined temperature during a previous defrost cycle, with the period between defrosts being controlled accordingly.

The inverse relationship method of estimating frost accumulation was also used in the system described in U.S. Pat. No. 4,156,350. This patent discloses a digital timer circuit for calculating the interval between defrost cycles, rather than the heat-absorbing body and analog circuitry disclosed in the earlier U.S. Pat. No. 3,111,894, but the method used to calculate the assumed frost accumulation period is otherwise the same in both prior patents, i.e., it is based on a direct inverse relationship between the previous defrost time and the frost accumulation period or time between defrost cycles.

While the adaptive defrost control system of U.S. Pat. Nos. 3,111,894 and 4,156,350 offers improved efficiency in some situations, the assumed inverse relationship is not necessarily optimal. For example, in situations where successive defrost times fluctuate significantly, the sign of the change in the frost accumulation period will lag the actual change, and the assumed and actual frost accumulation periods will thus rarely converge, resulting in an interval between defrosts which is shorter or longer than necessary.

To solve this problem, the interval between defrost cycles could be based on the inverse of an average of more than one previous defrost time, rather than on the inverse of a single previous defrost time. While this would reduce the effect of widely fluctuating defrost times, the resulting prediction would still not be optimal, as illustrated by the following example:

EXAMPLE OF WHY INVERSE RELATIONSHIP IS NOT OPTIMAL EVEN WHERE PREVIOUS TIMES ARE AVERAGED

If one assumes the following inverse relationship between the defrost time (dt) and the time between defrost operations (tbf):

dt=9 minutes→tbf=12 hours dt=10 minutes→tbf=11 hours dt=11 minutes→tbf=10 hours dt=12 minutes→tbf=9 hours, then for the situation in which the last three defrost times, in order, beginning with the earliest defrost time, change as follows (for example, due to a season change in ambient humidity):

dt=12 minutes dt=11 minutes dt=10 minutes.

Using just the last defrost time would give a time between defrosts of tbf=11 hours, while using the average of the last three defrost times would give a time between defrosts of tbf=10 hours.

The latter result would clearly be contrary to the trend of decreasing defrost times (12 min.→11 min.→10 min.) Consequently, using the average of the previous defrost times as the basis for the inverse relationship would actually give a worse result that just using the last defrost time, while using the last defrost time would also be inaccurate if the clear trend of decreasing frost accumulation were to continue.

In order to solve this problem, a new system would be desirable which takes into account the direction as well as the magnitude of changes in the previous defrost time.

In order to further improve the predictive accuracy of an adaptive defrost system, it would also be desirable to depart from the strict inverse relationship concept of the systems described in U.S. Pat. Nos. 3,111,894 and 4,145,350 by monitoring the compressor run cycles during a frost accumulation period and evaluating the run times based on a variable standard which takes into account the trends in the defrost interval. While U.S. Pat. No. 4,156,350 discloses monitoring of a total compressor run time during a frost accumulation period, individual cycles in the prior system are not compared to a variable standard for optimal efficiency.

SUMMARY OF THE INVENTION

Accordingly, it is a principal objective of the invention to improve the predictive accuracy of an adaptive defrost system for a refrigeration apparatus by initiating defrost operations based on defrost time trends rather than on an assumed inverse relationship between the frost accumulation period or interval between defrost cycles and the previous defrost time(s), in order to increase the incidence of convergence of the predictions with the actual frost accumulation.

It is also an objective of the invention to even further improve the accuracy of the frost accumulation prediction by continuously monitoring the compressor behavior during an interval between defrosts, and varying the defrost interval if, during a refrigeration cycle, the compressor run time exceeds a calculated maximum.

These objectives are achieved by providing an automatically defrosting refrigeration apparatus of the type which includes a refrigerant evaporator, a heater for defrosting the evaporator, defrost initiation means for initiating a defrost operation and timer means for measuring a defrost time required to carry out the defrost operation, in which the accumulated compressor run time interval between defrost operations is controlled based on a difference between two successive defrost times, rather than on just the previous defrost time or an average of previous defrost times, and in which the sign of the difference as well as the magnitude is taken into account.

In an especially preferred embodiment of the invention, the interval between defrost operations is decreased, subject to a predetermined minimum interval, by an amount equal to the difference if the difference between defrost times is less than zero or the most recent defrost time is greater than or equal to a predetermined defrost safety limit, and the interval is increased, subject to a predetermined maximum interval, by an amount equal to a sum of the difference and a constant time period offset if the defrost times have increased or stayed the same and the most recent defrost time is less than a predetermined defrost safety limit.

Upon start up of the preferred system, the initial interval between defrost cycles is preferably set to a minimum value, the refrigeration system is allowed to run until an accumulated compressor run time is greater than or equal to the initial interval, whereupon the defrost heater is turned on and the defrost time is stored, the next interval is set to the initial interval, and a defrost cycle initiated after the next interval in order to provide the two defrost time values necessary to begin the difference determination.

In addition to controlling the interval between defrost cycles based on a defrost time difference, the current continuous compressor run time is also preferably monitored, and the interval between defrost operations is set to a minimum value if the current continuous compressor run time is greater than the first continuous compressor run time, i.e., the continuous run time during the initial refrigeration cycle after a defrost cycle, which in turn cannot be greater than a variable based on the current interval between defrost cycles without also causing the interval between defrosts to be set to the minimum value.

DETAILED DESCRIPTION OF THE PREFERRED EMBODIMENTS

Figure 1:
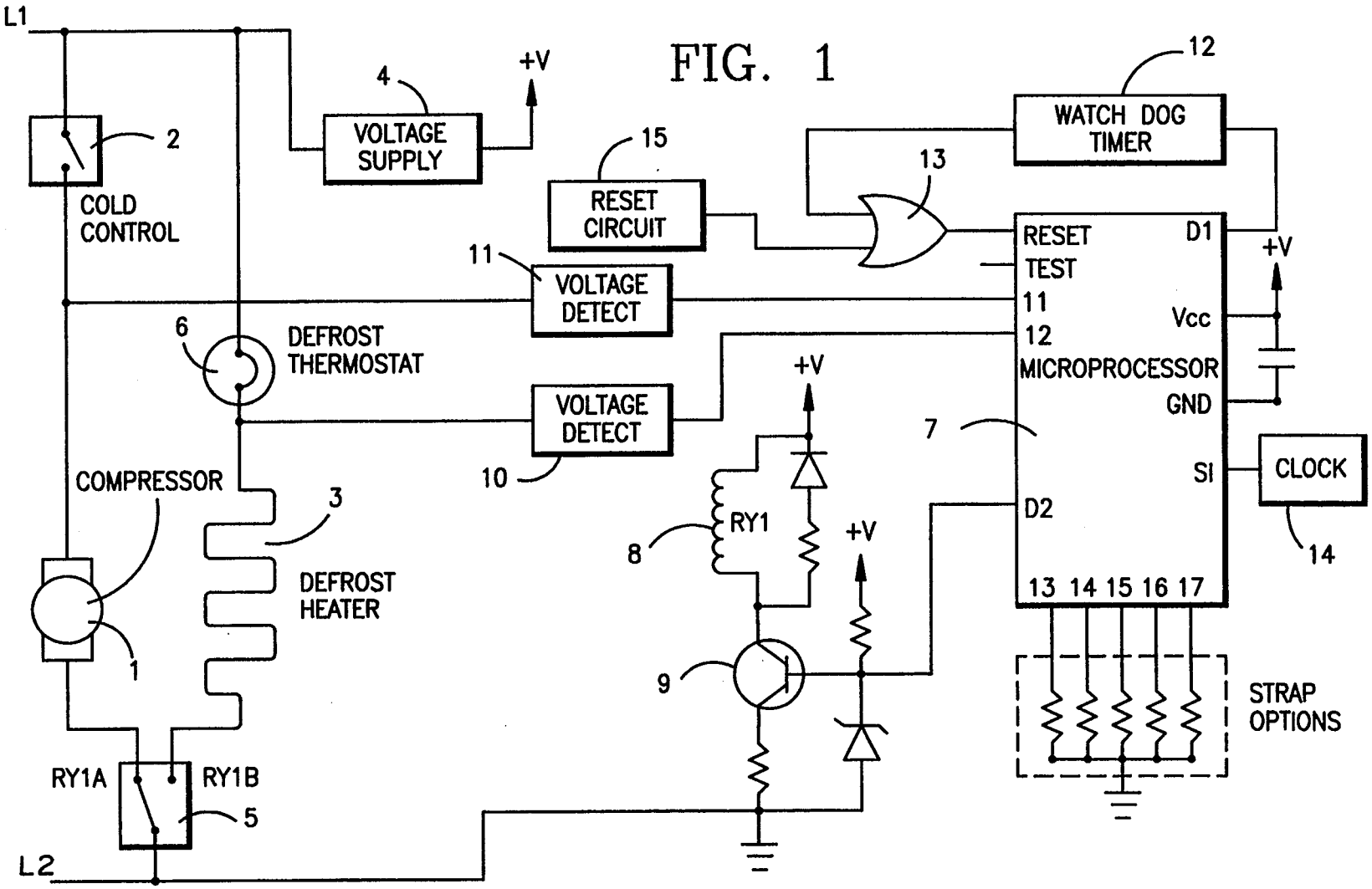
FIG. 1 is a schematic diagram of a refrigeration apparatus constructed in accordance with the principals of a preferred embodiment of the invention.

The implementation shown in FIG. 1 is a defrosting device which replaces a standard defrost timer on household refrigerators. The refrigeration apparatus includes a conventional compressor 1, cold control switch 2, defrost heater 3 for removing frost, and power supply 4. The defrosting device includes a relay switch 5 for preventing compressor operation and turning on heater 3 to initiate a defrost operation, and a conventional bi-metal type thermostat 6 which automatically shuts off the defrost operation when a predetermined temperature is sensed. A control circuit 7, preferably in the form of a microprocessor chip with an internal RAM and ROM is connected to control the relay coil 8 via a standard relay control circuit 9. The relay coil 8 is positioned to move the relay switch 5 to the defrost mode when energized, the relay normally allowing compressor operation.

The defrost time is monitored in this embodiment by monitoring the voltage to the defrost heater 3 via voltage detection circuit 10. In addition, a second voltage detection circuit 11 is preferably connected to the compressor power supply in order to monitor compressor run time, the compressor run time being controlled by operating switch 2 in a conventional fashion. A timer 12 which is connected to reset the microprocessor via OR gate 13 as necessary. The microprocessor also includes a conventional power line cycle driven clock 14 for providing all timing functions and a reset switch circuit 15 is connected to the reset terminal of microprocessor 7 via OR gate 13.

Figure 2A:
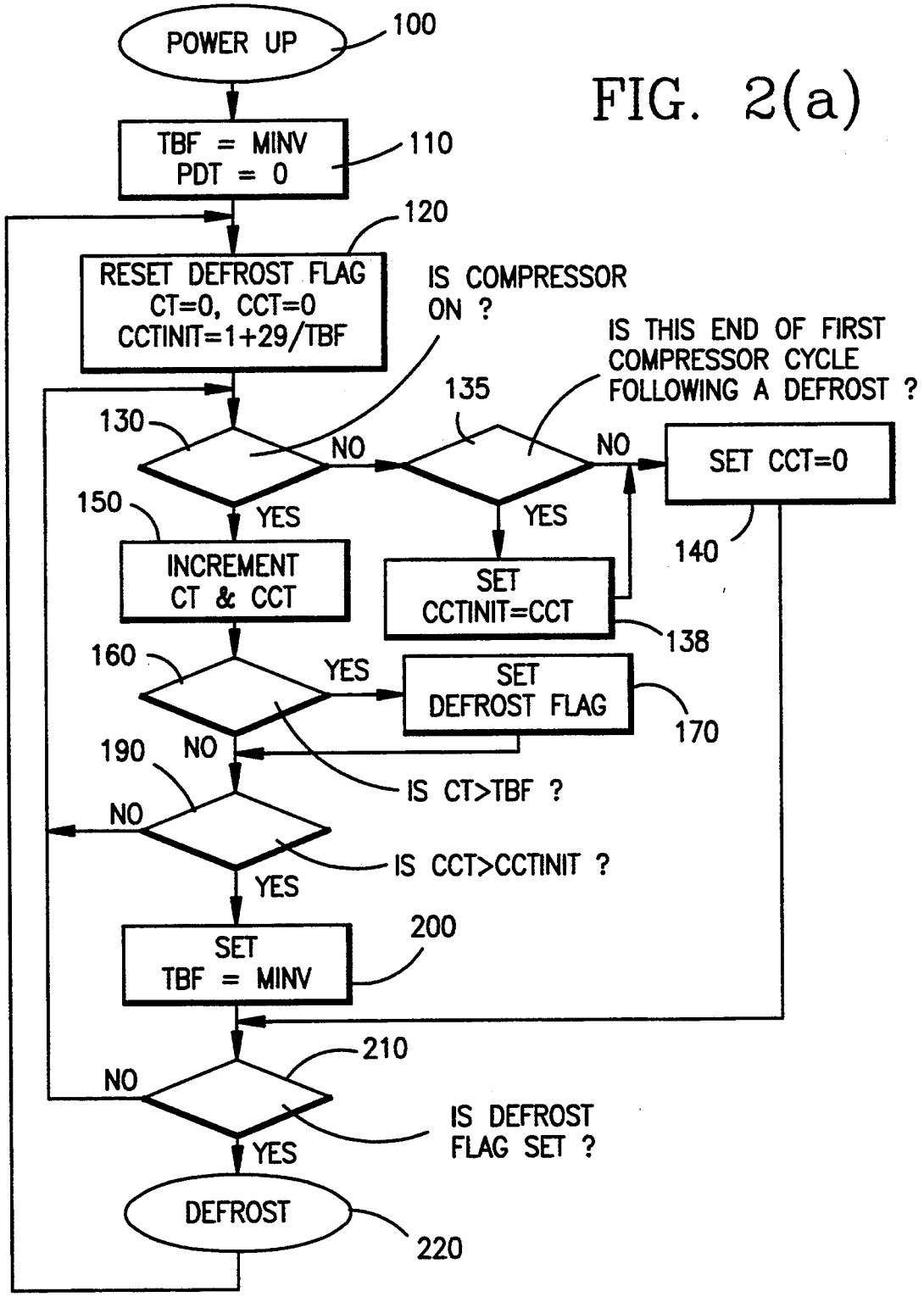
FIG. 2(*a*) and 2(*b*) form a flowchart illustrating the manner in which the interval between defrost is controlled by the circuit of FIG. 1 in accordance with the principles of the preferred embodiment of the invention.
Figure 2B:
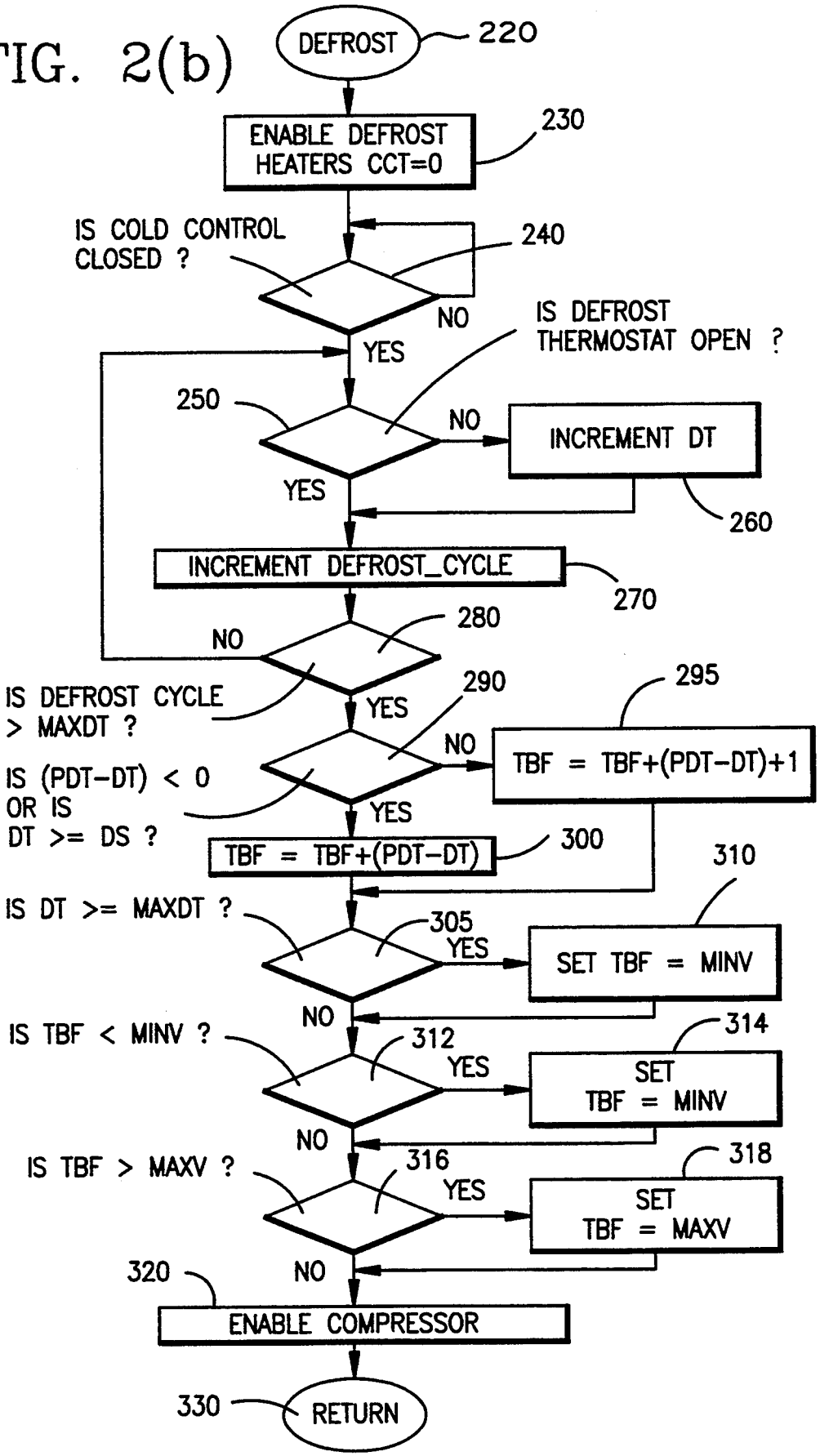

As shown in FIGS. 2(*a*) and 2(*b*), upon start-up, the controller begins with a power-up sequence (steps 100–120) which sets the compressor run time between defrosts variable (tbf) to a minimum value (minv) and clears the previous defrost time memory upon initial start-up. The refrigeration system is allowed to run in a normal fashion (steps 130–210, described in more detail below) until the accumulated compressor run time (ct) is greater than or equal to the tbf variable, at which time a defrost flag is set and the defrost subroutine is called (steps 210 and 220) on the next compressor off cycle. After initiation of the defrost cycle, the system waits for the defrost heater to be energized and then proceeds to monitor the defrost thermostat. From the time of defrost heater energization until the defrost thermostat opens or a maximum defrost time maxdt is reached, the defrost time variable dt is incremented, after which the frost accumulation or time between defrosts variable tbf is set according to the difference between the defrost time variable dt and a previous defrost time variable pdt stored in the microprocessor's RAM.

Following the first defrost cycle after a power-up condition, tbf is not altered. On subsequent defrost cycles, the difference between the two values is used to modify the time between defrosts (tbf) variable according to the following procedure, implemented in step 290, 295,300, 305, and 310, and based on the stored previous defrost time (pdt), the most recent defrost time (dt), a preset defrost safety limit (ds), a maximum defrost time (maxdt), a minimum time between defrosts (minv), and a maximum time between defrosts (maxv):

1. If $((pdt-dt)<0$ or $(dt>ds)$, then $tbf=tbf+60(pdt-dt)$.
2. If $((pdt-dt)>0)$ and $(dt<ds)$, then $tbf=tbf+60(pdt-dt)+1$.
3. If $(dt>maxdt)$, then $tbf=minv$.
4. If $(tbf<minv)$, then $tbf=minv$.

If $(tbf>maxv)$, then $tbf=maxv$.

The first condition indicates that for an increase in defrost times, or where the previous defrost time is greater than or equal to safety value ds, the time between defrosts is altered by the difference in defrost times. For a decreasing or steady defrost time in which the difference term is greater than or equal to zero, and so long as the defrost time is less than the safety value, the defrost time is increased by sum of the difference and one hour. Except for the constant 1, which is in units of hours, the defrost times are in units of minutes. The value of tbf is also compared to the limits minv and maxv such that if tbf is greater than maxv, tbf is set equal to the maximum value, and if tbf is less than minv, then tbf if set equal to the minimum value. After completing the defrost subroutine (steps 220–330) the refrigeration system is again allowed to operate in a normal fashion, with a timer accumulating the compressor run time (ct) until it is greater than or equal to tbf, at which time another defrost cycle is initiated.

In order to take into account actual conditions during the interval between defrosts, the preferred system takes into account compressor run times during individual refrigeration cycles. If any refrigeration cycle is excessively long, such that frost builds up at a rate greater than would be indicated by recent trends in the time between defrosts, the current time between defrosts is set to a minimum value. For example, in this embodiment, during the initial refrigeration cycle after a defrost cycle, tbf is set to minv whenever the condition exists where the initial continuous compressor run time cctinit exceeds the value of $(1+29/tbf)$. During subsequent refrigeration cycles, the current continuous compressor run time (cct) is monitored and, if the condition exists where cct exceeds the value of cctinit, the tbf variable is also set to minv. This portion of the control routine (steps 190–200) effectively overrides the above-described method of setting the time between defrosts variable tbf, where actual compressor running conditions have changed sufficiently to require such an override.

Having thus described a particularly preferred embodiment of the claimed invention, it will be appreciated by those skilled in the art that the basic concepts described above admit numerous variations, all of which are intended to be included within the scope of the invention. For example, the controller could take into account defrost times prior to the most recent two defrost times, and thereby obtain a more extensive chart of trends, with appropriate weights given to the most recent trends, and, for example, provision for eliminating aberrational jumps in the trends. Accordingly, the above description and drawings should not be read as limiting in any way, but rather the invention should be defined solely by the appended claims.

We claim:

1. In an automatically defrosting refrigeration apparatus including a refrigerant evaporator, a heater for defrosting the evaporator, defrost initiation means for initiating a defrost operation and timer means for measuring a defrost time required to carry out the defrost operation, the improvement comprising:

adaptive defrost means for changing an accumulated compressor run time interval between defrost operations, said adaptive defrost means including means for calculating a difference between two successive defrost times, and means for changing the interval between defrost operations based on the difference.

2. Apparatus as claimed in claim 1, wherein said means for changing the interval between defrost operations includes means for changing the interval between defrost operations by an amount equal to the difference if the difference between defrost times is less than zero.

3. Apparatus as claimed in claim 2, wherein said means for changing the interval between defrost operations based on said difference comprises means for changing the interval between defrost operations by an amount equal to the difference if a most recent defrost time is greater than or equal to a predetermined defrost safety limit.

4. Apparatus as claimed in claim 1, wherein said means for changing the interval between defrost operations based on said difference comprises means for changing the interval between defrost operations by an amount equal to the difference if a most recent defrost time is greater than or equal to a predetermined defrost safety limit.

5. Apparatus as claimed in claim 1, wherein said means for changing the interval between defrost operations based on the difference includes means for changing the interval between defrost operations by an amount equal to a sum of said difference and a constant time period offset if the difference is greater than or equal to zero.

6. Apparatus as claimed in claim 5, wherein said difference is in units of minutes and said constant time period is one hour.

7. Apparatus as claimed in claim 1, wherein said means for changing the interval between defrost operations based on said difference includes means for changing the interval between defrost operations by an amount equal to a sum of said difference and a constant time period if a most recent defrost time is less than a predetermined defrost safety limit.

8. Apparatus as claimed in claim 7, wherein said means for changing the interval between defrost operations based on said difference includes means for changing the interval between defrost operations by an amount equal to a sum of said difference and a constant time period if a most recent defrost time is less than a predetermined defrost safety limit, wherein said constant time period is one hour.

9. Apparatus as claimed in claim 7, wherein said means for changing the interval between defrost operations based on the difference includes means for changing the interval between defrost operations by an amount equal to a sum of said difference and a constant time period offset if the difference is greater than or equal to zero.

10. Apparatus as claimed in claim 1, wherein said means for changing the interval between defrost operations based on said difference comprises means for setting the interval between defrost operations to a predetermined minimum if a most recent defrost time exceeds a maximum predetermined defrost time limit.

11. Apparatus as claimed in claim 1, wherein said means for changing the interval between defrost operations based on said difference comprises means for preventing the interval between defrost operations from exceeding a maximum value.

12. Apparatus as claimed in claim 11, wherein said means for changing the interval between defrost operations further comprises means for preventing the interval from being less than a minimum value.

13. Apparatus as claimed in claim 1, wherein said means for changing the interval between defrost operations based on said difference includes means for preventing the interval from being less than a minimum value.

14. Apparatus as claimed in claim 1, further comprising means for setting an initial interval between defrosts to a minimum value, means for allowing said refrigeration system to run until an accumulated compressor run time is greater than or equal to the initial interval, means for also then causing the defrost initiation means to initiate a defrost, means for setting a next interval to the initial interval, and means for again causing the defrost initiation means to initiate a defrost before calculating an initial difference in defrost times.

15. Apparatus as claimed in claim 1, further comprising means for measuring a first continuous compressor run time after a defrost operation and, if the first continuous compressor run time is greater than a constant plus a term proportional to a reciprocal of a most recent interval between defrost operations, setting next interval between defrost operations to a minimum value.

16. Apparatus as claimed in claim 15, wherein in said constant is one and said term is 29 multiplied by the reciprocal of the most recent interval, in units of hours.

17. Apparatus as claimed in claim 15, further comprising means for subsequently comparing a next continuous compressor run time to the first continuous compressor run time, and if said subsequent continuous compressor run time exceeds said first continuous compressor run time, setting the interval between defrost operations to a minimum value.

18. Apparatus as claimed in claim 1, further comprising means for comparing a continuous compressor run time with a first continuous compressor run time after a defrost operation, and setting the interval between defrost operations to a minimum value if the continuous compressor run time exceeds the first continuous compressor run time.

19. In an automatically defrosting refrigeration apparatus including a refrigerant evaporator, a compartment cooled by the evaporator, thermostatic control means for cycling the evaporator ON and OFF as required to maintain a set temperature in the compartment, defrost means for periodically defrosting the evaporator at various intervals, and an override means responsive to continuous operation of the evaporator for more than a predetermined length of time to shorten an interval between defrost operations, the improvement wherein the override means comprises means for measuring a first continuous compressor run time after a defrost operation and if the first continuous compressor run time exceeds a variable which is a function of most recent interval between defrost operations, setting a next interval between defrosts to a minimum value.

20. Apparatus as claimed in claim 19, wherein said variable which is a function of the time between defrosts is equal to a first constant plus a second constant multiplied by a reciprocal of the previous interval between defrost operations.

21. Apparatus as claimed in claim 20, wherein said variable equals $1+29/tbf$ where tbf is the previous interval between defrost operations and the variable is in units of hours.

22. Apparatus as claimed in claim 19, further comprising means for measuring a subsequent continuous compressor run time and comparing said subsequent continuous compressor run time with said initial continuous compressor run time, and setting the time between defrosts to a minimum value if said subsequent continuous compressor run time exceeds said initial continuous compressor run time.

23. In a method of controlling an interval between successive defrosting operations in a refrigeration apparatus, including the steps of (a) initiating a defrost operation, and (b) measuring a time required to carry out the defrost operation, the improvement comprising the steps of:

(c) calculating a difference between two previous defrost times, (d) establishing the interval before a next defrosting operation based on the difference between the two previous defrost times, and (e) initiating a defrost operation at an end of the interval.

24. A method as claimed in claim 23, wherein step (d) comprises the step of changing the interval by an amount equal to the difference if the difference is less than zero.

25. A method as claimed in claim 24, wherein step (d) comprises the step of changing the interval by an amount equal to the difference if the most recent defrost time is greater than a predetermined defrost safety time.

26. A method as claimed in claim 23, wherein step (d) comprises the step of changing the interval by an amount equal to the difference if the difference is less than zero or if the defrost time exceeds a predetermined defrost safety time.

27. A method as claimed in claim 23, wherein step (d) comprises the step of changing the interval by an amount equal to a sum of the difference and an offset constant if the difference is greater than or equal to zero.

28. A method as claimed in claim 27, wherein the difference is in units of minutes and said constant is one, in units of hours.

29. A method as claimed in claim 23, wherein step (d) comprises the step of changing the interval by an amount equal to a sum of the difference and an offset constant if the defrost time is less than a predetermined defrost safety time.

30. A method as claimed in claim 29, wherein the difference is in units of minutes and the constant is one, in units of hours.

31. A method as claimed in claim 23, wherein step (d) comprises the step of changing the interval by an amount equal to a sum of the difference and a constant if the difference is greater than or equal to zero and the defrost time is less than a defrost safety time.

32. A method as claimed in claim 23, further comprising the step of setting the interval to a predetermined minimum if a most recent defrost time equals a predetermined maximum defrost time.

33. A method as claimed in claim 23, further comprising the step of setting the interval to a maximum value if a calculated interval is greater than a maximum value.

34. A method as claimed in claim 23, further comprising the step of setting the defrost interval to a minimum value if a calculated defrost interval is less than a minimum value.

35. A method as claimed in claim 23, further comprising the steps of beginning a power up sequence by setting the interval to a minimum value, allowing the refrigeration apparatus to run until the accumulated compressor run time is greater than or equal to the interval, waiting for a next compressor off cycle and initiating a standard defrost, and measuring the time from this initialization until the defrost thermostatic control means opens to end the defrost operation, and repeating the sequence to obtain two defrost times whose difference can be calculated.

36. A method as claimed in claim 23, further comprising the step of measuring a first continuous compressor run time after a defrost operation and if the first continuous compressor run time is greater than a calculated value based on the time between defrosts, setting the interval to a minimum value.

37. A method as claimed in claim 36, further comprising the step of measuring a subsequent continuous compressor run time and if the subsequent continuous compressor run time is greater than the first continuous compressor run time, setting the interval to a minimum value.

38. In a method of automatically defrosting a refrigeration apparatus, including the step of (a) periodically defrosting an evaporator at varying intervals, the improvement comprising the step of:

(b) measuring a first continuous compressor run time after a defrost and if it exceeds a variable which is a function of an interval between defrosts, setting the next time between defrosts to a minimum value.

39. A method as claimed in claim 38, wherein step (b) comprises the step of comparing the first continuous compressor run time to a variable which is equal to a constant and a term proportional to a reciprocal of the most recent defrost interval.

40. A method as claimed in claim 39, wherein the variable is $1+29/tbf$, where tbf is the interval between defrosts and units are in hours.

41. A method as claimed in claim 39, further comprising the steps of comparing a second continuous compressor run time with the first continuous compressor run time, and setting the interval between defrosts to a minimum value if the second continuous compressor run time is greater than the first continuous compressor run time.

* * * * *